US005421243A

United States Patent [19]

Burkett et al.

[11] Patent Number: 5,421,243

[45] Date of Patent: Jun. 6, 1995

[54] COMPACT REFRIGERANT COMPRESSOR

[75] Inventors: Michael J. Burkett, Lockport; Nikolaos A. Adonakis, Grand Island, both of N.Y.

[73] Assignee: General Motors Corporation, Detroit, Mich.

[21] Appl. No.: 210,489

[22] Filed: Mar. 21, 1994

[51] Int. Cl.[6] ..... F16J 1/00

[52] U.S. Cl. ..... 92/177; 92/71; 417/269

[58] Field of Search ..... 92/12.2, 71, 57, 177, 92/165 PR; 417/269

[56] References Cited

U.S. PATENT DOCUMENTS

| | | | |
|---|---|---|---|
| 345,751 | 7/1886 | Weimer | 92/177 |
| 2,551,430 | 5/1951 | Estey | 92/177 |
| 2,660,365 | 11/1953 | Paget | 92/177 |
| 3,165,030 | 1/1965 | Humphrey | 92/177 |
| 4,351,227 | 9/1982 | Copp, Jr. et al. | 92/71 |
| 4,610,606 | 9/1986 | Hazzard et al. | 92/177 |

FOREIGN PATENT DOCUMENTS

| | | | |
|---|---|---|---|
| 2913418 | 10/1980 | Germany | 92/177 |
| 276546 | 9/1927 | United Kingdom | 92/177 |

*Primary Examiner*—Thomas E. Denion
*Attorney, Agent, or Firm*—Patrick M. Griffin

[57] ABSTRACT

An automotive air conditioning compressor of more compact and efficient design is achieved with a unique cylinder bore and piston shape. While the cylinder bores and pistons are arrayed in a circle about the central axis of the round cylinder block, the bores and pistons themselves are not round in cross section. Instead, each has a pair of flattened sides lying more or less parallel to radial planes of the cylinder block. As a consequence, only solid webs separate the cylinder bores, not empty spaces, as in a conventional block. The ratio of total bore volume to block volume is greater, and the compressor is more compact for a given capacity. In addition, the non round cross section of bores and pistons resists piston twisting.

1 Claim, 1 Drawing Sheet

COMPACT REFRIGERANT COMPRESSOR

This invention relates to refrigerant compressors in general, and specifically to a refrigerant compressor with a unique cylinder block and cylinder bore configuration that makes for a compact unit as well as improved piston operation.

BACKGROUND OF THE INVENTION

Piston operated refrigerant compressors, especially automotive air conditioning compressors, have typically incorporated a cylinder block of circular cross section as well as cylinder bores of circular cross section, which are arrayed in a circular pattern about the central axis of the block. Matching shape pistons are reciprocated within the cylinder bores by mechanisms such as swash plates or wobble plates that turn on engine powered drive shafts. The circular shape of the cylinder block, and the circular array of the cylinder bores within the block, is dictated by the circular action of the swash plate type reciprocating mechanisms. The circular cross section of the individual cylinder bores and pistons is apparently universal, so much so that the term cylinder is typically taken to mean a cylinder of circular cross section, although the mathematical definition of cylinder is not nearly so restrictive.

One inevitable result of providing a circular array of cylinder bores which themselves have a circular cross section is the creation of large, empty interstitial spaces between the cylinder bores. An example may be seen in U.S. Pat. No. 4,351,227, FIG. 2. These interstitial, residual spaces have been used to provide part of the necessary network of refrigerant passages within the compressor, such as suction cross over passages, but they are generally much larger than is necessary for such purposes, and, in a real sense, represent a wasted space. Another drawback of circular cross section pistons and cylinder bores is that the piston can easily turn or twist within the bore, which action must be resisted by the mechanical interconnection between the pistons and the piston reciprocating mechanism.

SUMMARY OF THE INVENTION

The invention provides a compact refrigerant compressor in which the existence of unused space within the cylinder block is essentially eliminated, and in which piston twisting is substantially eliminated.

In the preferred embodiment disclosed, the cylinder block has a circular cross section, and the reciprocating mechanism is a conventionally acting swash plate. Therefore, the cylinder bores and pistons are also arrayed in a circular pattern about the central drive axis, as the swash plate requires. Rather than having a circular cross section individually, however, each cylinder bore has a cross section which is substantially based on a circular sector of the cylinder block cross section, a pie shape, in effect. Each cylinder bore is equal size and symmetrically arranged, leaving a spoke like array of webs radiating from the center of the block. Only the webs separate the cylinder bores, and they are only as thick as is required for block structural integrity. Consequently, there is essentially no wasted volume within the block itself, which has maximum compactness. Each piston has a matching cross section, so the non circular cross section of the cylinder bores and pistons acts to prevent piston twisting, reducing loading on the swash plate to piston interconnection.

DESCRIPTION OF THE PREFERRED EMBODIMENT

These and other features of the invention will appear from the following written description, and from the drawings, in which.

Figure 1:
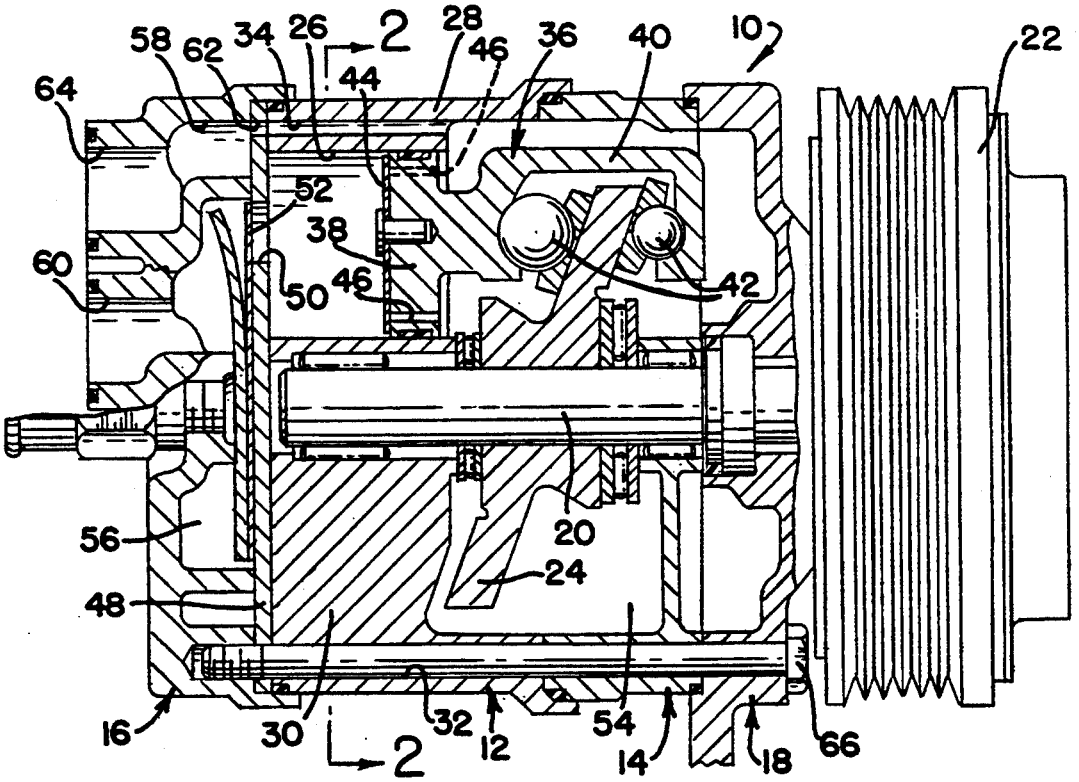
FIG. 1 is a cross section of a compressor made according to the invention, showing the drive shaft and drive shaft pulley in elevation.

Referring to the Figures, a compressor indicated generally at 10 is illustrated as a single acting type, meaning that it's pistons have a single head. The operation is simpler to describe than a double acting compressor, but the particular structural features of the invention will be understood to operate as well in a double acting design. The number of and general operation of the components in compressor 10 is conventional, but their structure and shape is different. The basic structural framework of compressor 10 includes a cylinder block, indicated generally at 12, a cylindrical shell 14, a rear head indicated generally at 16, and a front head 18. The block 12 and shell 14 together comprise a basic canister of circular cross section, which is capped and closed at each end by the heads 16 and 18. A drive shaft 20 runs centrally through compressor 10, along the central axis of block 12 and shell 14. Shaft 20 is driven by a standard drive pulley assembly 22. A conventional swash plate 24 is fixed to shaft 20 and turns therewith. As with all swash plates, the angle of plate 24 with respect to shaft 20 causes diametrically opposed points at its rim to move back and forth parallel to the central axis, so as to be capable of reciprocating pistons back and forth. However, the unique structure described in detail below can potentially allow plate 24 to be smaller in diameter, for a given compressor capacity.

Figure 2:
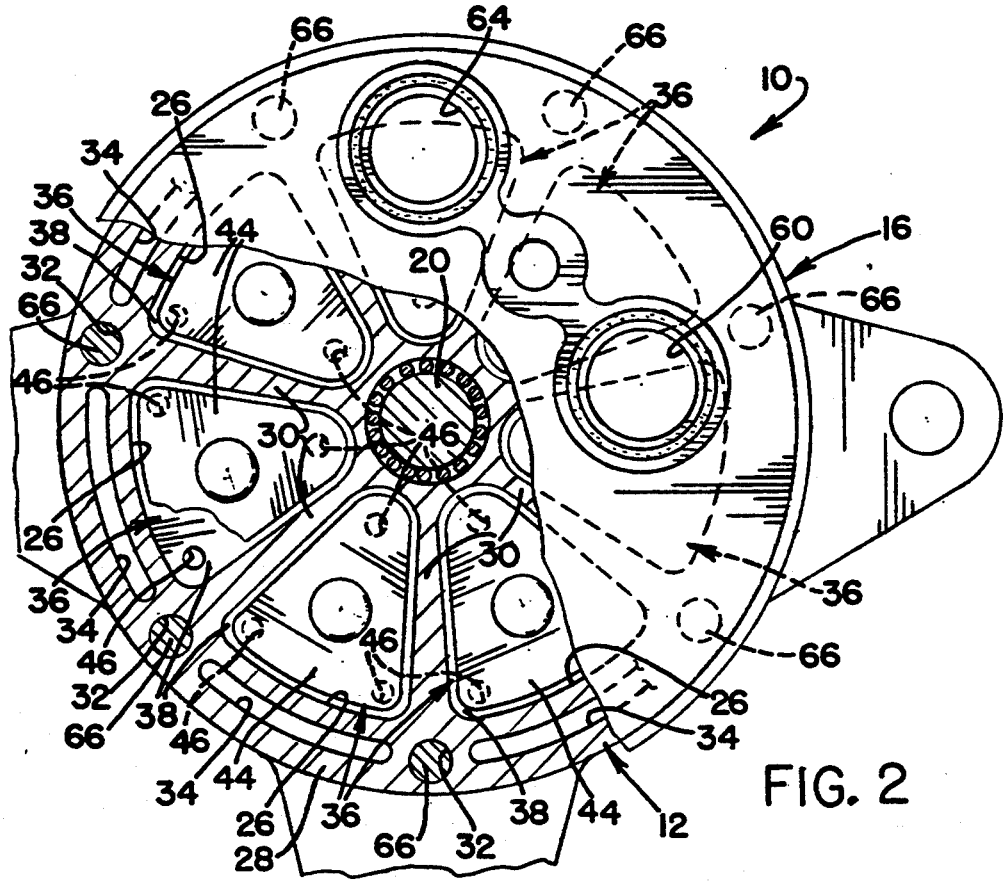
FIG. 2 is a cross section taken along the line 2—2 in FIG. 1 showing part of the front head in elevation.

Referring next to FIG. 2, cylinder block 12 has seven identical and evenly spaced cylinder bores 26 formed through it. While block 12 is circular in cross section overall, the individual cylinder bores 26 are not. Instead, each bore 26 has a cross section that is substantially in the form of a circular sector of the circle that comprises the cross section of cylinder block 12. Each bore 26 could also be mathematically described as a cylinder whose generator is a straight line moving parallel to the central axis of cylinder block 12 and whose directing curve, that is, the closed curve that the straight line generator follows as it generates the bore 26, is the pie shaped curve best seen in FIG. 2. This closed curve, in turn, is substantially based on a sector of the circular cross section of block 12. Unlike a true, geometric circular sector, however, the cross section of bore 26 is given radiused or rounded corners, rather than sharp comers. The outermost edges of each bore 26 lie well inside the outermost diameter of cylinder block 12, leaving a relatively thick outer wall 28. The unique shape of the bores 26 leaves no empty volume between their adjacent flat sides, only an equal number of solid webs 30 radiating out like wheel spokes to the wall 28. Wall 28 has a plurality of bolt holes 32 drilled through it, each located at the structurally solid intersection of a web 30 with wall 28. Wall 28 also has an equal number of evenly spaced, generally arcuate slots 34, each cut through between a pair of bolt holes 32. The net result is that block 12 has a very high ratio of bore 26 volume to overall volume, while there is almost complete symmetry among all voids and solid portions of block 12, giving good structural integrity.

Referring to both Figures, each bore 26 contains a respective piston, indicated generally at 36, each of which has a head 38 that fits closely, but slidably, within a bore 26, and a body or bridge section 40 that is operatively joined to the rim of plate 24 by a conventional pair of balls and sliding shoes 42. The top surface of each piston head 38 has a thin metal, resilient intake reed valve 44 of matching shape riveted centrally to it, covering three suction intake ports 46 located out near the corners of piston head 38. The top of each piston head 38 faces a valve plate 48 through which a respective discharge port 50 opens, covered by a conventional discharge reed valve assembly 52. The back of each piston head 38 faces what may be referred to as a crank case cavity 54, being the more or less empty volume surrounding swash plate 24 within compressor shell 14. Rear head 16 is cast with an inboard annular discharge chamber 56 and an outboard annular intake chamber 58, which are discrete and fluid sealed from one another. The discharge chamber 56 is open to the bores 26 across the discharge ports 50 and to the outside through a discharge outlet 60. Intake chamber 58 is open to crankcase cavity 54 through ports 62 that coincide with the slots 34, and is open to the outside through a suction inlet 64. The block 12, shell 14, plate 48, and heads 16 and 18 are all held together by seven bolts 66 that run through the bolt holes 32. Mechanically and structurally, compressor 10 is thus very solid and robust. Plate 48 and rear head 16 rest firmly on the webs 30 and wall 28, and the bolts 66 run continuously through bolt holes 32, unlike conventional designs, where the bolts may be unsupported along much of their length. The mechanical operation of compressor 10 is described next.

Still referring to the Figures, low pressure refrigerant vapor from an evaporator enters intake chamber 58 through suction inlet 64, reaching crankcase cavity 54 freely through ports 62 and slots 34. The relatively wide and thin slots 34 in the outer wall 28 present a large heat transfer path through wall 28, another advantage of the shape and arrangement of the bores 26 within block 12. From cavity 54, vapor is drawn into a bore 26 as piston head 38 pulls back, lowering the pressure within bore 26 and causing the intake reed valve 44 to bend up at the corners and admit vapor through the intake ports 46. The distance out to the corners of the pie shaped intake reed valve 44 allows it to bend up easily on the suction stroke. As the piston head 38 reverses, pressurized vapor is forced out of bore 26 through discharge port 50, through discharge reed valve assembly 52, into discharge chamber 56, and ultimately out discharge outlet 60 and to a condenser for cooling. The higher bore to block volume means that the diameter and length of block 12 can be less, for a given compressor capacity. Swash plate 24 can also be smaller in diameter and lighter, taking less power from shaft 20. The piston heads 38 are also prevented from twisting within the matching bores 26, by virtue of their non circular cross sections, meaning that the ball and shoes assemblies 42 interconnecting the pistons 36 to plate 24 do not have to resist such twisting action. In conclusion, while basic operation is conventional, several operational advantages result from the unique structure, the primary objective of which is increased compactness.

Variations in the embodiment disclosed could be made. A conventional, round piston could be flattened off on two sides in planes that lay along or parallel to radial planes of the cylinder block. This would give each piston a shape similar to the pie shape of piston head 38, though not as pronounced, as well as the cylinder bores. This modification alone, in conjunction with arraying the cylinder bores in a circular pattern, would create flat radiating webs between the cylinder bores that were bisected by radial planes of the cylinder block, essentially like the webs 30. This would eliminate the empty interstitial spaces between the cylinder bores, and could be easier to manufacture. The pistons would also resist twisting within the bores, but the cylinder bore to block volume ratio would not be quite as favorable as in the preferred embodiment, with its more pronounced pie shape of the piston heads 38. Different configurations for the cylinder block slots, like 34, that allow vapor entry to the crank case cavity 54 could be used, such as simple, round drilled holes. More than one such drilling per piston might be needed to provide adequate flow, but there is more than adequate room at almost any point in wall 28 for that. Of course, different numbers of pistons, or double sided pistons, could be used, although double sided pistons would require suction and discharge cross over passages, as well as suction and discharge chambers in both heads. Therefore, it will be understood that it isn't intended to limit the invention to just the embodiment disclosed.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. A compact refrigerant compressor having improved structural strength and fluid flow, comprising, a front head having a generally annular intake chamber into which refrigerant vapor is inlet and a discrete, generally annular discharge chamber from which refrigerant vapor is exhausted, a rear head, a hollow cylindrical shell, a cylinder block having a cylindrical outer wall with an outer diameter comparable to said shell surrounding a central axis and a plurality of three or more cylinder bores arrayed evenly in a circle about said central axis each of which is generally triangular in cross section, thereby creating an equal plurality of radial webs between said bores and radiating out to said outer wall, said cylinder block further including a plurality of axially extending bolt holes running through said outer wall, each located at the intersection of a respective web and outer wall and a plurality of thin, arcuate, axially extending slots running through said outer wall, each located between a pair of bolt holes, radially aligned with said front head intake chamber, and radially proximate the outer surface of said block outer wall, a plurality of bolts running continuously through said bolt holes to retain said cylinder block, shell and heads together thereby forming a robust structure with an internal crankcase cavity and with said arcuate slots open both to said crankcase cavity and to said front head intake chamber, a plurality of matching shape pistons slidably received in said cylinder bores, a powered shaft running through said cylinder block along said central axis, and, a reciprocating mechanism operatively connected between said shaft and pistons to reciprocate said pistons within said cylinder bores, whereby, when said pistons are reciprocated, refrigerant vapor is drawn from said intake chamber through said arcuate slots and into said crankcase cavity, thereby achieving substantial heat transfer through said cylinder block outer wall.

* * * * *